US010861637B2

(12) United States Patent
Lee et al.

(10) Patent No.: US 10,861,637 B2
(45) Date of Patent: Dec. 8, 2020

(54) COIL COMPONENT

(71) Applicant: SAMSUNG ELECTRO-MECHANICS CO., LTD., Suwon-si (KR)

(72) Inventors: Hwan Soo Lee, Suwon-si (KR); Han Wool Ryu, Suwon-si (KR); Hyo Chan Oh, Suwon-si (KR); Jin Ho Ku, Suwon-si (KR); Byoung Hwa Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 259 days.

(21) Appl. No.: 15/824,195

(22) Filed: Nov. 28, 2017

(65) Prior Publication Data

US 2018/0268990 A1 Sep. 20, 2018

(30) Foreign Application Priority Data

Mar. 16, 2017 (KR) ..... 10-2017-0033270

(51) Int. Cl.
*H01F 27/29* (2006.01)
*H01F 27/28* (2006.01)
(Continued)

(52) U.S. Cl.
CPC ..... *H01F 27/29* (2013.01); *H01F 27/24* (2013.01); *H01F 27/2804* (2013.01); *H01F 41/041* (2013.01); *H01F 2027/2809* (2013.01)

(58) Field of Classification Search
CPC ..... H01F 27/29; H01F 27/2804; H01F 27/24; H01F 41/041; H01F 2027/2809;
(Continued)

(56) References Cited

U.S. PATENT DOCUMENTS 7,696,849 B2 * 4/2010 Ito ..... H05K 3/3442 336/192
9,349,522 B2 * 5/2016 Ohkubo ..... H01F 27/2804
(Continued)

FOREIGN PATENT DOCUMENTS

JP 11-204337 7/1999
JP 2005-210010 A 8/2005
(Continued)

OTHER PUBLICATIONS

Notice of Office Action issued in Japanese Patent Application No. 2017-233506, dated Sep. 4, 2018 (English translation).
(Continued)

*Primary Examiner* — Tuyen T Nguyen
(74) *Attorney, Agent, or Firm* — Morgan, Lewis & Bockius LLP

(57) ABSTRACT

A coil component includes a support member, an internal coil supported by the support member, and external electrodes connected to the internal coil. The external electrodes may each include a first layer coming into contact with the internal coil and a second layer disposed on a surface of the first layer. The first layer may serve as a buffer layer for improving a contact property between the internal coil and the external electrode. The second layer may be disposed to come into at least partial contact with a first end portion of the support member and a second end portion of the support member.

22 Claims, 5 Drawing Sheets

(51) Int. Cl.
*H01F 27/24* (2006.01)
*H01F 41/04* (2006.01)

(58) Field of Classification Search
CPC ..... H01F 27/292; H01F 17/0013; H01F 2017/048; H01F 1/015; H01F 5/00; H01F 27/28
See application file for complete search history.

(56) References Cited

U.S. PATENT DOCUMENTS

| | | | | |
|---|---|---|---|---|
| 2011/0025442 | A1* | 2/2011 | Hsieh | H01F 17/0013 336/200 |
| 2012/0119863 | A1* | 5/2012 | Wu | H01F 27/292 336/192 |
| 2014/0176284 | A1 | 6/2014 | Lee et al. | |
| 2015/0136463 | A1 | 5/2015 | Lee et al. | |
| 2016/0042857 | A1 | 2/2016 | Chun et al. | |
| 2017/0032884 | A1 | 2/2017 | Choi et al. | |

FOREIGN PATENT DOCUMENTS

| | | | |
|---|---|---|---|
| JP | 2005-353714 | A | 12/2005 |
| JP | 2006-041184 | A | 2/2006 |
| JP | 2006-287063 | A | 10/2006 |
| JP | 2014-127717 | A | 7/2014 |
| JP | 2016-32093 | A | 3/2016 |
| JP | 2016-143759 | A | 8/2016 |
| JP | 2017-034227 | A | 2/2017 |
| KR | 10-1999-0066108 | | 8/1999 |
| KR | 10-1474168 | B1 | 12/2014 |
| KR | 10-2016-0019266 | | 2/2016 |

OTHER PUBLICATIONS

Office Action issued in corresponding Japanese Application No. 2017-233506, dated Jan. 8, 2019.
Office Action issued in Japanese Patent Application No. 2017-233506 dated Aug. 6, 2019, with English translation.

* cited by examiner

COIL COMPONENT

CROSS-REFERENCE TO RELATED APPLICATION(S)

This application claims benefit of priority to Korean Patent Application No. 10-2017-0033270 filed on Mar. 16, 2017 in the Korean Intellectual Property Office, the disclosure of which is incorporated herein by reference in its entirety.

BACKGROUND

1. Field

The present disclosure relates to a coil electronic component, and more particularly, to a power inductor.

2. Description of Related Art

An inductor, such as a coil electronic component, is a representative passive element used in electronic circuits together with resistors and capacitors to remove noise. The inductor may be combined with the capacitor using electromagnetic characteristics to provide a resonance circuit used to amplify a signal in a specific frequency band, a filter circuit, or the like.

Recently, metal based power inductors formed using an amorphous metal or crystalline metal material have been widely used in mobile devices due to having excellent DC bias characteristics and power conversion efficiency characteristics. Since it is predicted that the applications of the metal based power inductors will be gradually expanded into a range of industrial and electrical fields in the future, a need exists for a power inductor satisfying requirements for a high level of reliability.

SUMMARY

An aspect of the present disclosure may provide a coil component in which connectivity between an internal coil and an external electrode connected thereto is improved.

According to an aspect of the present disclosure, a coil component may include a support member, and an internal coil supported by the support member and including a plurality of coil patterns. The internal coil is electrically connected to external electrodes each including a plurality of layers. In this case, the external electrodes may each include a first layer coming into contact with the internal coil and a second layer disposed on a surface of the first layer. The second layers are disposed to come into at least partial contact with end portions of the support member.

According to another aspect of the present disclosure, a coil component may include a body and first and second external electrodes disposed on first and second end surfaces of the body, respectively. The first and second external electrodes each include at least first and second layers. A support member and an internal coil supported by the support member may be embedded by a magnetic material in the body. Opposing end portions of the support member may be exposed to the first and second end surfaces of the body, respectively. An area occupied by the first layer of the first external electrode on the first end surface may be smaller than an overall area of the first end surface, and an overall area occupied by the first layer of the second external electrode on the second end surface may be smaller than an overall area of the second end surface.

According to another aspect of the present disclosure, a coil component includes a body including a magnetic material, an internal coil disposed within the body, and external electrodes disposed on surfaces of the body. Each external electrode includes a first layer disposed to contact a portion of the internal coil extending to a respective outer surface of the body, the first layer including a metal and being free of a resin. Each external electrode further includes a second layer disposed on the first layer and including a metal and a resin.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Hereinafter, a coil component according to an exemplary embodiment in the present disclosure will be described, but the disclosure not necessarily limited thereto.

Figure 1:
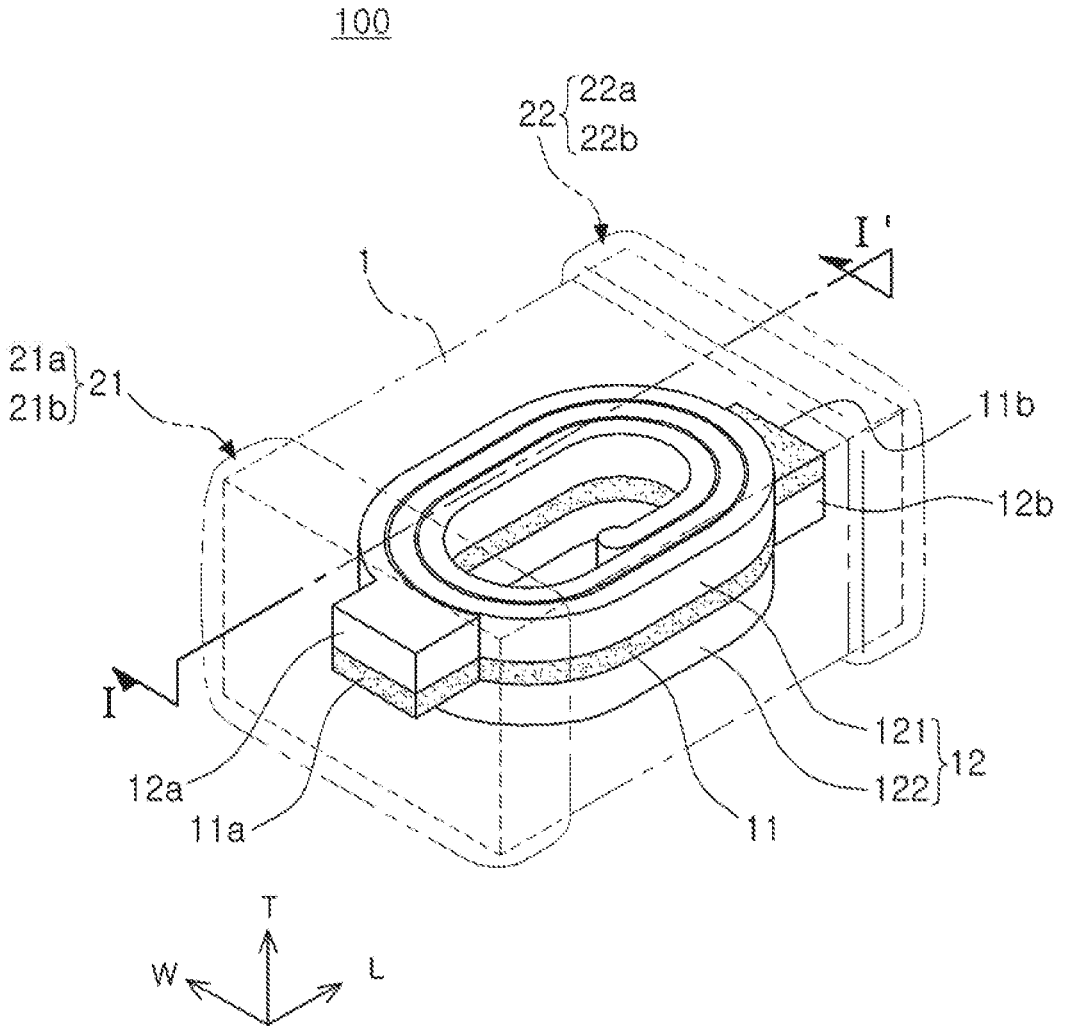
FIG. 1 is a schematic perspective view illustrating a coil component according to an exemplary embodiment.
Figure 2:
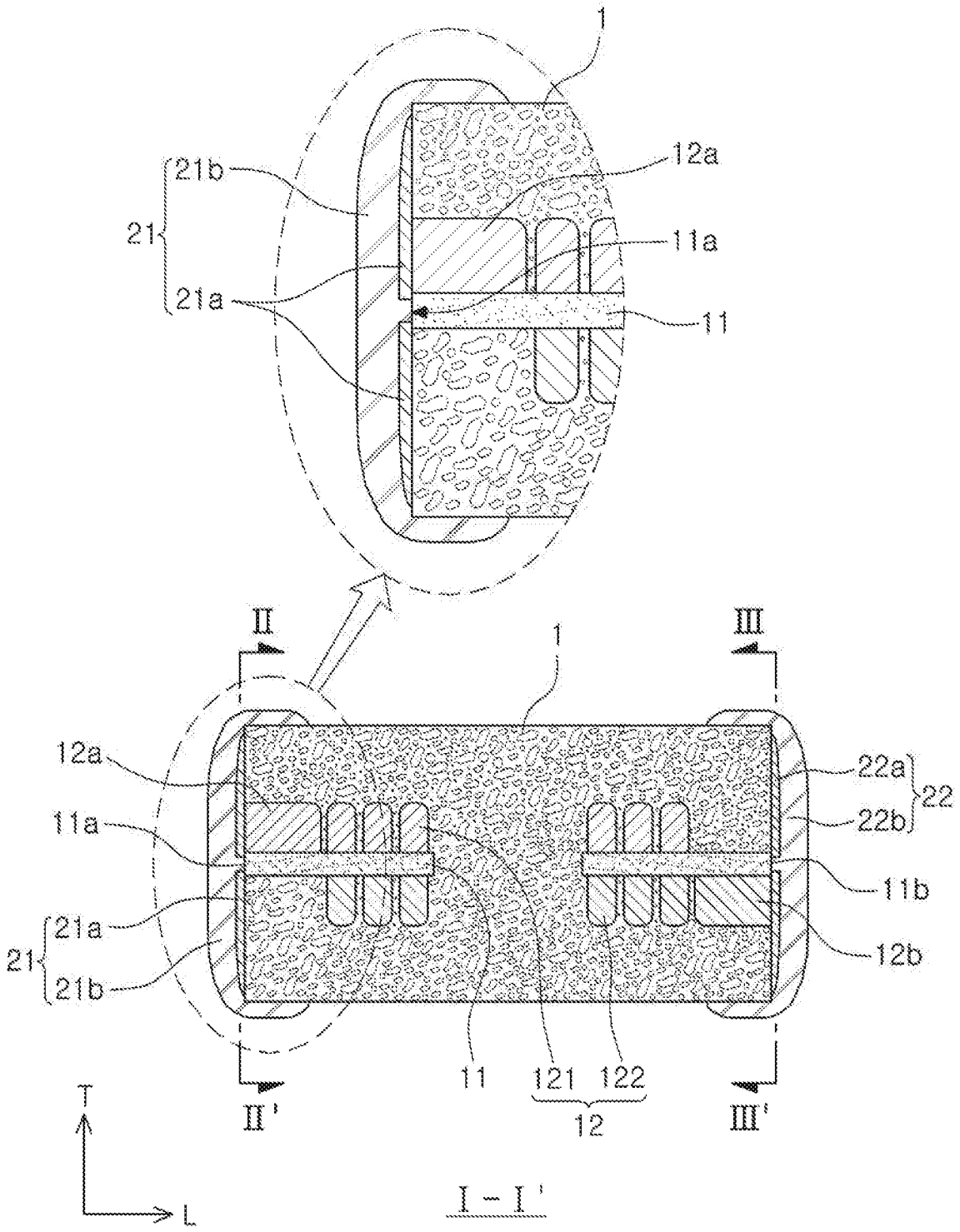
FIG. 2 is a schematic cross-sectional view of the coil component of FIG. 1 taken along line I-I'.

FIG. 1 is a schematic perspective view illustrating a coil component according to an exemplary embodiment, and FIG. 2 is a cross-sectional view of the coil component taken along line I-I' of FIG. 1.

Referring to FIGS. 1 and 2, a coil electronic component 100 may include a body 1 and first and second external electrodes 21 and 22 disposed on an external surface of the body.

The body 1 may form an exterior of the coil electric component and have upper and lower surfaces opposing each other in a thickness (T) direction, first and second end surfaces opposing each other in a length (L) direction, and first and second side surfaces opposing each other in a width (W) direction to have a substantially hexahedral shape. However, the body 1 is not limited thereto.

The body 1 may contain a magnetic material. For example, the body 1 may be formed by providing a ferrite or metal based soft magnetic material. An example of the ferrite may include ferrite known in the art such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy containing at least one selected from the group consisting of Fe, Si, Cr, Al, and Ni. For example, the metal based soft magnetic material may contain Fe—Si—B—Cr based amorphous metal particles, but is not limited thereto. The metal based soft magnetic material may have a particle diameter ranging from 0.1 μm or more to 20 μm or less and be contained in a form in which the metal based soft magnetic material is dispersed on or in a polymer such as an epoxy resin, polyimide, or the like.

A support member 11 may be disposed in the body 1 and serve to appropriately support an internal coil while allowing the internal coil to be more easily formed. Preferably, the support member may be formed in a form of a plate having insulation properties. For example, the support member may be a printed circuit board (PCB), but is not limited thereto. The support member 11 may have a thickness sufficient to support the internal coil. For example, the thickness of the support member 11 may be preferably about 60 μm. However, in consideration of expanded application of the coil component to industrial or electrical products actually used in harsh environments, as well as electronic components for information technology (IT), it is preferable to use a support member having a thickness of about 100 μm. In addition, it is preferable to use a support member having glass transition temperature (Tg) characteristics in a relatively high temperature range ranging from 250° C. or more to 350° C. or less.

Next, the internal coil 12 supported by the support member 11 will be described. The internal coil 12 may include an upper coil 121 disposed on an upper surface of the support member 11 and a lower coil 122 disposed on a lower surface of the support member 11. Each of the upper and lower coils may include a plurality of coil patterns and/or coil windings, and a width and a thickness of each of the coil patterns and/or coil windings may be suitably selected depending on the requirements or conditions.

The internal coil 12 may be formed of a metal having excellent electric conductivity. For example, the internal coil 12 may be formed of silver (Ag), palladium (Pd), aluminum (Al), nickel (Ni), titanium (Ti), gold (Au), copper (Cu), platinum (Pt), alloys thereof, or the like.

The internal coil 12 may include a first coil end 12*a* electrically connected to the first external electrode 21 and a second coil end 12*b* electrically connected to the second external electrode 22. The first coil end is one end of the upper coil, and the second coil end is one end of the lower coil. Here, the other ends of the upper and lower coils may be electrically connected to each other through a via hole penetrating through the support member. A single via hole may be provided, but a plurality of via holes may be implemented in a single electrode pad. In a case in which the plurality of via holes are formed, reliability may be further secured as compared to a case in which a single via hole is formed. The reason is that when a plurality of via holes are used, electrical connection between the upper and lower coils may be maintained even though an open-circuit occurs in one of the plurality of via holes (e.g., electrical connection may be maintained by another via hole adjacent thereto.

Next, the first and second external electrodes 21 and 22 disposed on the external surface of the body 1 and electrically connected to the internal coil will be described. Although only a case in which the external electrodes having a "E" shape is illustrated in the accompanying drawings, the shape of the external electrode is not limed thereto. For example, the external electrodes may have a "C", "U", or "L" shape. Alternatively, the external electrodes may also be implemented as bottom electrodes disposed only on the lower surface of the body. In the case of the bottom electrodes, the internal and external electrodes may be electrically connected to each other by manufacturing the internal coil and then disposing the internal coil upright so that an exposed surface of the internal coil is exposed to the lower surface of the body.

The first external electrode 21 may be electrically connected to the first coil end 12*a* of the internal coil, and the second external electrode 22 may be electrically connected to the second coil end 12*b* of the internal coil.

The first external electrode 21 may include a plurality of layers. That is, the first external electrode 21 may include a first layer 21*a* electrically connected to the first coil end of the internal coil as a layer of the external electrode disposed in an innermost portion of the external electrode adjacent to the body and coil, and a second layer 21*b* disposed on a surface of the first layer. In this case, the second layer 21*b* may be formed of a metal-epoxy layer, for example a silver-epoxy composite layer. Since the internal coil contains a metal material, in a case of directly disposing the second layer on the internal coil, there is a problem in securing a suitable contact property between the internal coil and the external electrode. In a case in which the suitable contact property is not secured, contact resistance may be increased, or reliability of the electronic component may be significantly deteriorated due to a distance between the internal coil and the external electrode. Further, securing of the contact property is considered as a more important issue at the time of applying the electronic component to industrial and electronic fields as well as IT devices.

Therefore, in the coil electronic component 100 according to the present disclosure, since the first layer 21*a* is interposed as a buffer layer for improving contact reliability between the internal coil and the external electrode and the second layer 21*b* is formed of the silver-epoxy composite layer, a contact defect which may occur between the internal coil and the external electrode may be prevented. The first layer 21*a* may contain a metal material having excellent electric conductivity similarly to the internal coil. For example, it is preferable that the first layer 21*a* contains one or more of copper (Cu) and nickel (Ni) but does not contain a resin (e.g., the first layer 21*a* may be free of a resin).

In addition, the first layer 21*a* may be interposed between the external electrode and the internal coil as the buffer layer, such that an effect of decreasing contact resistance while improving contact reliability may be implemented.

Referring to FIG. 2, the first layer 21*a* may be disposed not to entirely cover one end portions 11*a* of the support member 11. Here, it is preferable that an average thickness T1 of the first layer is controlled to be equal to or less than ½ of a thickness Ts of the support member. In a case in which the average thickness T1 of the first layer is greater than ½ of the thickness Ts of the support member, the first layer may cover an entire surface of one end portion of the support member, which is not preferable. The thickness T1 of the first layer may be measured in a length (L) direction, while the thickness Ts of the support member may be measured in a thickness (T) direction shown in FIGS. 1 and 2.

Of course, a region of the surface of one end portion of the support member that is not covered by the first layer may come in contact with the second layer 21*b* formed on the first layer. As described above, the region that is not covered by the first layer may be understood as a disconnected portion, and this disconnected portion may be covered by the second layer to directly come in contact with the second layer.

Figure 3A:
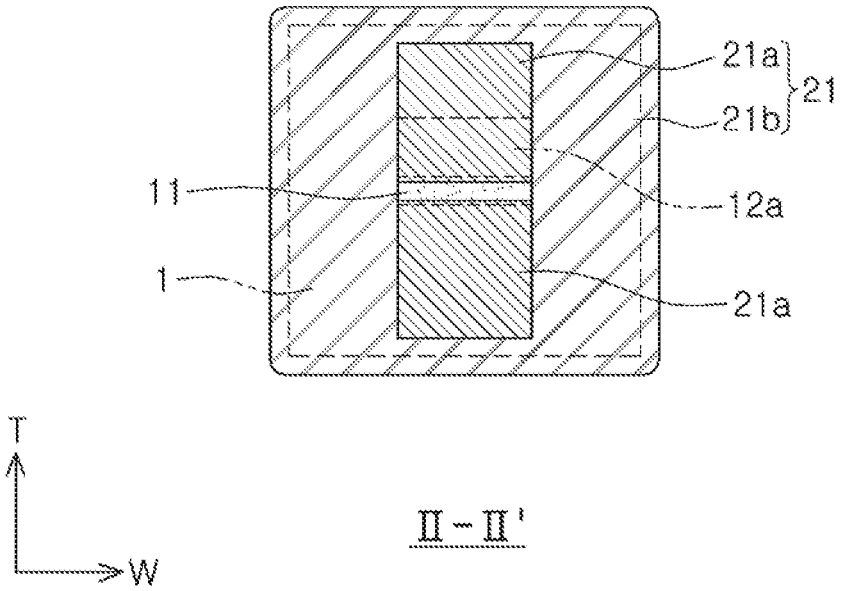
FIG. 3A is a schematic cross-sectional view taken along line II-II' of FIG. 2.

Meanwhile, a structure in which the first layer is disposed on the first end surface of the body will be described in more detail with reference to FIG. 3A. FIG. 3A is a schematic cross-sectional view taken along line II-II' of FIG. 2. In detail, the line II-II' of FIG. 2 may substantially coincide with a cutting line spaced apart from the first end surface of the body to the first external electrode by a predetermined distance.

Here, in FIG. 3A, the region of one end portion of the support member 11 that is not covered by the first layer 21*a* of the first external electrode 21 may be covered by the second layer 21*b* of the first external electrode, but for convenience of explanation, one end portion of the support member is illustrated as it is. This will be equally applied to FIG. 3B.

Referring to FIG. 3A, an area occupied by the first layer 21*a* of the external electrode 21 on the first end surface of the body 1 is smaller than an area of the first end surface of the body 1. This may mean that some region of the first end surface of the body 1 is not covered by the first layer 21*a*, and some region of the first end surface that is not covered by the first layer 21*a* may correspond to at least a portion of the surface of the body to which one end portion of the support member 11 is exposed.

Some region of the first end surface of the body 1 that is not covered by the first layer 21*a* may be covered by the second layer 21*b* of the external electrode.

A method of forming the first layer on the first end surface of the body is not limited. For example, a plating method, a metal paste application method, or a deposition method using the sputtering may be appropriately selected.

Further, although not illustrated, the external electrode may further include a third layer formed on a surface of the second layer 21*b*. The third layer, which is a configuration for allowing the coil component to be easily connected to the outside, may contain, for example, one or more of nickel (Ni) and tin (Sn) to thereby be formed of a Ni—Sn alloy.

Next, the second external electrode 22 may be disposed on the second end surface of the body 1, and a description of contents of the first external electrode 21 described above may be applied to the second external electrode 22 as it is. In detail, FIG. 3B is provided for reference.

Figure 3B:
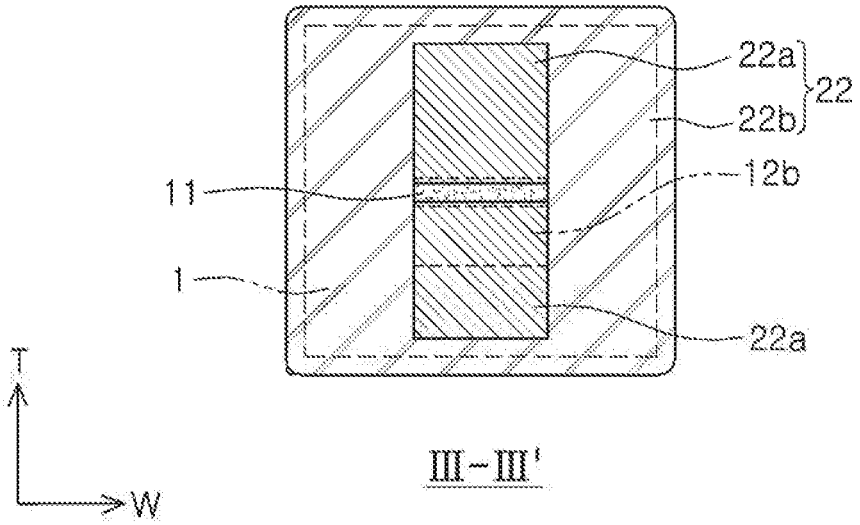
FIG. 3B is a schematic cross-sectional view taken along line of FIG. 2.

FIG. 3B is a schematic cross-sectional view taken along line of FIG. 2. In detail, the line of FIG. 2 may substantially coincide with a cutting line spaced apart from the second end surface of the body 1 to the second external electrode 22 by a predetermined distance.

The following Table 1 illustrates comparison results of Rdc values of inductors in Comparative Example 1 and Inventive Example 1 depending on positions of external electrodes. Both of the inductors in Comparative Example 1 and Inventive Example 1 were inductors having the following specifications: 2520 1.0T, and 10 pH. The inductor in Comparative Example 1 was different from that in Inventive Example 1 in that a metal-epoxy composite layer was directly formed as an external electrode connected to an internal coil. The inductor in Inventive Example 1 further included a first layer as a buffer layer as compared to the inductor in Comparative Example 1. Here, the first layer contained copper as a main ingredient, and had an average thickness of about 10 μm. However, the average thickness of the first layer was not particularly limited as long as the average thickness was in a range of 0.5 μm to 30 μm.

TABLE 1

| Position of External Electrode (First External Electrode-Second External Electrode) | Comparative Example 1 [mΩ] | Inventive Example 1 [mΩ] |
|---|---|---|
| First End Surface-Second End Surface | 27 | 26 |
| Upper Surface-Upper Surface | 34 | 28 |
| Lower Surface-Lower Surface | 35 | 29 |
| First Side Surface-Second Side Surface | 41 | 30 |

As illustrated in Table 1, the Rdc value in Comparative Example 1 was about 1 to 9 mΩ larger than that in Inventive Example 1, and a deviation of the Rdc values depending on the position of the external electrode in Comparative Example 1 was larger than that in Inventive Example 1.

Therefore, it may be appreciated that a Rdc value and a deviation of the Rdc values depending on a position of an external electrode may be decreased by introducing a first layer which directly comes in contact with an internal coil but does not directly come in contact with at least a portion of a support member as a buffer layer at the time of forming an inductor in which a metal-resin composite is used as the external electrode.

Further, in a case of performing a soldering heat resistance test on the inductors in Inventive Example 1 and Comparative Example 1 (that is, at the time of checking changes in Ls and Rdc after charging the inductors in a solder bath. In this case, a temperature of the solder bath was 260° C., and a charging time was seconds), it may be clearly appreciated that in Inventive Example 1, heat-shock resistance was improved as compared to Comparative Example 1. More specifically, in Comparative Example 1, Ls or Rdc characteristics were gradually deteriorated from when the temperature reached 270° C. On the contrary, in Inventive Example 1, even though the temperature was increased up to 350° C., Ls or Rdc characteristics were not substantially deteriorated.

Figure 4:
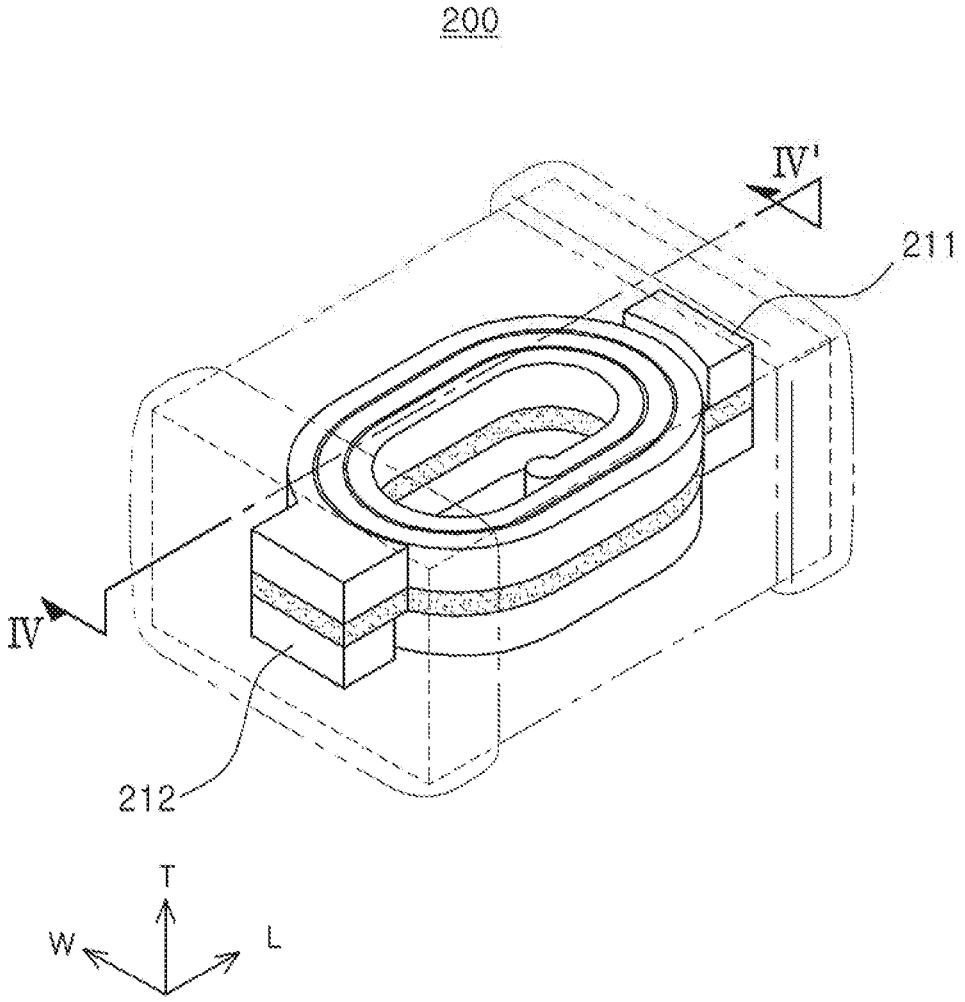
FIG. 4 is a schematic perspective view illustrating a modified example of the coil component of FIG. 1.
Figure 5:
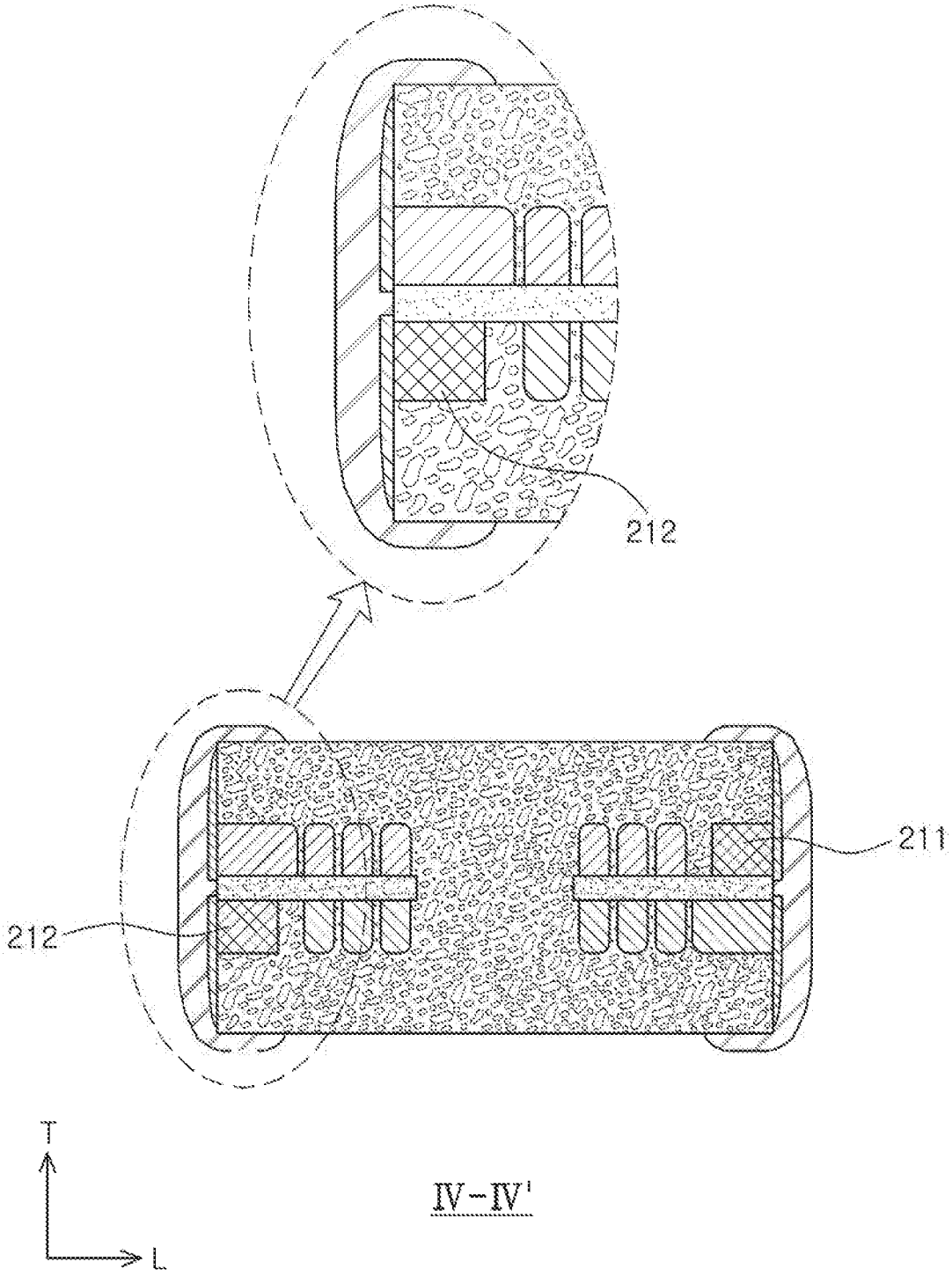
FIG. 5 is a schematic cross-sectional view taken along line IV-IV' of FIG. 4.

Meanwhile, FIG. 4 is a schematic perspective view illustrating a modified example of the coil component of FIG. 1; and FIG. 5 is a schematic cross-sectional view taken along line IV-IV' of FIG. 4.

A coil electronic component 200 corresponding to the modified example of the above-mentioned coil electronic component 100 will be described with reference to FIGS. 4 and 5. For convenience of explanation, a description of contents overlapping those of the above-mentioned coil electronic component 100 will be omitted.

Referring to FIGS. 4 and 5, the coil electronic component 200 may further include a first dummy electrode 211 disposed on the same plane as a plane on which an upper coil is disposed and a second dummy electrode 212 disposed on the same plane as a plane on which a lower coil is disposed.

The first dummy electrode 211 may be disposed to be physically spaced apart from an internal coil, and the second dummy electrode 212 may also be disposed to be physically spaced apart from the internal coil.

The first and second dummy electrodes 211 and 212 may be exposed to second and first end surfaces of a body, respectively. As a result, an exposed surface of the first dummy electrode 211 may come in contact with a first layer of a second external electrode, and an exposed surface of the second dummy electrode 212 may come in contact with a first layer of a first external electrode. The first and second dummy electrodes may be disposed, such that a contact property of the external electrodes disposed on an external surface of the body may be increased.

Except for the description described above, a description of features overlapping those of the above-mentioned coil component according to the exemplary embodiment in the present disclosure will be omitted.

As described above, with the coil components 100 and 200 according to the present disclosure, the contact property between the internal coil and the external electrode may be improved and thus reliability of a product may be improved, contact resistance may be decreased, and the deviation of Rdc values depending on the position of the external electrode may also be decreased.

As set forth above, according to exemplary embodiments as described in the present disclosure, the coil component has a low direct current resistance (Rdc) value while having reliability improved by improving the contact property between the internal coil and the external electrode.

While exemplary embodiments have been shown and described above, it will be apparent that modifications and variations could be made without departing from the scope of the present disclosure as defined by the appended claims.

What is claimed is:

1. A coil component comprising:

a support member;

an internal coil supported by the support member and including a plurality of coil patterns; and external electrodes connected to the internal coil and each including a first layer coming into contact with the internal coil and a second layer disposed on the first layer, wherein the first layers each have a through-hole extending therethrough, and the second layers are each disposed to extend through the through-hole of a corresponding first layer and come into at least partial contact with a corresponding first or second end portion of the support member.

2. The coil component of claim 1, wherein a region of a first end surface of the support member that does not come in contact with the second layer comes in contact with the first layer of at least one of the external electrodes, and a region of a second end surface of the support member that does not come in contact with the second layer comes in contact with the first layer of at least one of the external electrodes.

3. The coil component of claim 1, wherein the first layer includes a single metal or an alloy.

4. The coil component of claim 3, wherein the first layer contains one or more of copper (Cu) and nickel (Ni).

5. The coil component of claim 1, wherein the second layer includes a metal-epoxy composite.

6. The coil component of claim 1, wherein an average thickness T1 of the first layer is equal to or less than ½ of a thickness Ts of the support member.

7. The coil component of claim 1, wherein the support member and the internal coil are embedded in a body containing a magnetic material.

8. A coil component comprising:

a body containing a magnetic material, in which an internal coil supported by a support member is embedded, and having upper and lower surfaces opposing each other in a thickness direction, first and second side surfaces opposing each other in a length direction, and first and second end surfaces opposing each other in a width direction; and first and second external electrodes disposed on the first and second end surfaces of the body, respectively, wherein first and second end surfaces of the support member are exposed to and coplanar with the first and second end surfaces of the body, respectively, the first and second external electrodes each include a first layer and a second layer disposed on the first layer, an area occupied by the first layer of the first external electrode on the first end surface of the body is smaller than an area of the first end surface of the body, and an area occupied by the first layer of the second external electrode on the second end surface of the body is smaller than an area of the second end surface of the body.

9. The coil component of claim 8, wherein the second layer of each of the first and second external electrodes covers a surface of the first layer of the corresponding one of the first and second external electrodes.

10. The coil component of claim 8, wherein the first layer of each of the first and second external electrodes does not contain a resin, and the second layer of each of the first and second external electrodes contains a resin.

11. The coil component of claim 8, wherein the first layer is disposed to include two separate portions spaced apart from each other on the first end surface.

12. The coil component of claim 11, wherein the two separate portions of the first layer and a space therebetween are covered by the second layer.

13. The coil component of claim 8, wherein the internal coil includes upper and lower coils, the upper coil being disposed above the first end surface, the lower coil being disposed below the second end surface, and the upper and lower coils being connected to each other through one or more via holes penetrating through the support member.

14. The coil component of claim 13, wherein a first dummy electrode is disposed on a plane on which the upper coil is disposed, and is exposed to the second end surface of the body to thereby be connected to the second external electrode, a second dummy electrode is disposed on a plane on which the lower coil is disposed, and is exposed to the first end surface of the body to thereby be connected to the first external electrode, and the first and second dummy electrodes are disposed to be spaced apart from the upper and lower coils, respectively.

15. The coil component of claim 8, wherein the support member has a glass transition temperature (Tg) in a range of 250° C. or more to 350° C. or less.

16. The coil component of claim 8, wherein the external electrode further includes a third layer formed on a surface of the second layer, the third layer containing one or more of Ni and Sn.

17. A coil component comprising:

a body including a magnetic material;

a support member embedded within the body;

an internal coil disposed on the support member and within the body; and external electrodes disposed on first and second outer surfaces of the body, wherein each external electrode includes a first layer disposed to contact a portion of the internal coil extending to a respective outer surface of the first and second outer surfaces of the body, the first layer including a metal and being free of a resin, each external electrode further includes a second layer disposed on the first layer, the second layer contacting at least a portion of the respective outer surface of the first and second outer surfaces, and the second layer including a metal and a resin, the internal coil and support member extend to outer surfaces of the body, and the second layer of each external electrode is disposed on the first layer and contacts a portion of the support member extending to a respective outer surface of the body.

18. The coil component of claim 17, wherein the first layer of each external electrode is disposed to include two separate portions spaced apart from each other on the respective surface of the body, and the second layer of each respective external electrode contacts the portion of the support member in a space between the two separate portions of the first layer of the respective external electrode.

19. The coil component of claim 17, wherein the first layer includes a single metal or an alloy.

20. The coil component of claim 19, wherein the first layer contains one or more of copper (Cu) and nickel (Ni).

21. The coil component of claim 17, wherein the second layer includes a metal-epoxy composite.

22. The coil component of claim 17, wherein the first layers of the external electrodes are fully covered by the second layers of the external electrodes.

* * * * *